US012180621B2

(12) United States Patent
Bell et al.

(10) Patent No.: US 12,180,621 B2
(45) Date of Patent: Dec. 31, 2024

(54) WOVEN INFLATABLE DEVICES AND METHOD OF MAKING THE SAME

(71) Applicants: Thomas G. Bell, Küsnacht (CH); Natalie A. Candrian, Küsnacht (CH)

(72) Inventors: Thomas G. Bell, Küsnacht (CH); Natalie A. Candrian, Küsnacht (CH)

( * ) Notice: Subject to any disclaimer, the term of this patent is extended or adjusted under 35 U.S.C. 154(b) by 224 days.

(21) Appl. No.: 17/654,051

(22) Filed: Mar. 8, 2022

(65) Prior Publication Data

US 2022/0290340 A1 Sep. 15, 2022

Related U.S. Application Data

(60) Provisional application No. 63/158,451, filed on Mar. 9, 2021.

(51) Int. Cl.

| | |
|---|---|
| ***B63H 8/56*** | (2020.01) |
| ***A47C 4/54*** | (2006.01) |
| ***B63H 8/18*** | (2020.01) |
| ***B65D 81/03*** | (2006.01) |
| ***B65D 81/05*** | (2006.01) |
| ***D03D 1/02*** | (2006.01) |
| ***F25D 3/08*** | (2006.01) |

(52) U.S. Cl.

CPC ..... *D03D 1/02* (2013.01); *A47C 4/54* (2013.01); *B63H 8/18* (2020.02); *B63H 8/56* (2020.02); *B65D 81/03* (2013.01); *B65D 81/052* (2013.01); *F25D 3/08* (2013.01)

(58) Field of Classification Search

CPC ... A47C 4/54; B63H 8/18; B63H 8/56; B65D 81/03; B65D 81/052; D03D 1/02; F25D 3/08

USPC ..... 297/452.41, 464, 465, 466, 467, 468; 114/39.18

See application file for complete search history.

(56) References Cited

U.S. PATENT DOCUMENTS 1,976,320 A * 10/1934 Austin ..... B61D 31/00 297/452.41 X
2,582,439 A * 1/1952 Kavanagh ..... A47K 3/12 297/452.41 X
2,623,574 A * 12/1952 Damsch ..... A47C 1/146 297/452.41 X
3,112,956 A * 12/1963 Schick ..... A47C 7/029 297/452.41 X (Continued)

FOREIGN PATENT DOCUMENTS

FR 3026728 A1 * 4/2016 ..... F25D 3/08
WO WO-9417697 A1 * 8/1994 ..... A47C 23/065

OTHER PUBLICATIONS

Candrian-Bell, Natalie A et al., "Inflatable Jacquard-Woven Textiles for Structural Applications," U.S. Appl. No. 15/561,449, filed Sep. 25, 2017 255 pages. File History of U.S. Patent Application Publication #2 (U.S. Pat. No. 20180119320).

(Continued)

*Primary Examiner* — Rodney B White

(74) *Attorney, Agent, or Firm* — Alleman Hall & Tuttle LLP

(57) ABSTRACT

Woven inflatable devices and methods for making woven inflatable devices are provided. The woven inflatable devices include a laminated sheet with inflatable regions that when inflated cause the laminated sheet to transform from a planar shape to a three-dimensional shape such as a chair, container, or kiteboard harness.

4 Claims, 11 Drawing Sheets

(56) References Cited

U.S. PATENT DOCUMENTS 3,265,438 A * 8/1966 Regan ..... A47C 4/54 297/452.41
3,408,107 A * 10/1968 Savage ..... A47C 4/54 297/452.41
3,420,574 A * 1/1969 Smith ..... A47C 4/54 297/452.41 X
3,499,682 A * 3/1970 Orenstein ..... A47C 4/54 297/452.41
3,572,836 A * 3/1971 Khanh ..... A47C 4/54 297/452.41
3,584,914 A * 6/1971 Williams ..... A47C 4/54 297/452.41 X
3,608,966 A * 9/1971 Kredenser ..... A47C 4/54 297/452.41
3,610,689 A * 10/1971 Smith ..... A47C 4/54 297/452.41
3,740,095 A * 6/1973 Nail ..... B63B 34/52 297/452.41 X
4,189,181 A * 2/1980 Noble ..... A47C 27/085 297/452.41
4,504,989 A * 3/1985 Maltz ..... A47C 4/54 297/DIG. 3
4,545,773 A * 10/1985 Evert ..... B63H 8/56 114/39.18
4,578,042 A * 3/1986 Evert ..... B63C 9/115 441/117
4,601,667 A * 7/1986 Hull ..... A47C 4/54 297/DIG. 3
4,639,960 A * 2/1987 Quillen ..... A47C 27/081 297/452.41 X
4,708,393 A * 11/1987 Fallis ..... A47C 7/021 297/452.41
4,724,558 A * 2/1988 Reiff ..... A47C 1/146 297/DIG. 3
4,761,011 A * 8/1988 Sereboff ..... A47C 27/085 297/452.41 X
4,826,249 A * 5/1989 Bradbury ..... B60N 2/7011 297/452.41
4,836,605 A * 6/1989 Greenwood ..... A47D 1/103 297/452.41
4,932,721 A * 6/1990 Anthony ..... A47C 4/54 297/452.41
4,965,899 A * 10/1990 Sekido ..... A47C 7/467 297/284.6
5,005,902 A * 4/1991 Farnworth ..... A47D 1/02 297/452.41 X
5,149,172 A * 9/1992 Davis ..... A47D 1/103 297/DIG. 3
5,292,175 A * 3/1994 Artz ..... B60N 2/2812 297/452.41
5,292,176 A * 3/1994 Artz ..... B60N 2/2806 297/452.41
5,335,382 A * 8/1994 Huang ..... A43B 13/203 297/452.41
5,335,968 A * 8/1994 Sheridan ..... A47D 1/103 297/DIG. 3
5,474,361 A * 12/1995 Hwang ..... A47C 1/146 297/452.41
5,487,197 A * 1/1996 Iskra, Jr. ..... A47C 7/021 297/452.41
5,560,056 A * 10/1996 Tai ..... A45F 3/22 297/452.41 X
5,586,347 A * 12/1996 Frischknecht ..... A47C 27/081 5/713
5,638,565 A * 6/1997 Pekar ..... B65D 81/052 5/710
5,699,569 A * 12/1997 Schwarz-Zohrer .... A47D 9/005 5/655
5,769,231 A * 6/1998 Batsford ..... B65D 81/052 206/522
5,893,184 A * 4/1999 Murphy ..... A47C 27/148 297/452.41 X
6,042,186 A * 3/2000 Kojic ..... A47C 4/54 297/452.41 X
6,161,902 A * 12/2000 Lieberman ..... A47C 4/54 297/452.41
6,224,444 B1 * 5/2001 Klimenko ..... A47C 15/006 297/452.41 X
6,357,061 B1 * 3/2002 Gonzalez ..... A47K 3/12 4/581
6,382,729 B1 * 5/2002 Wu ..... A47C 7/425 297/452.41 X
6,677,026 B1 * 1/2004 Yates ..... A47C 27/085 297/452.41 X
6,886,204 B2 * 5/2005 Kasatshko ..... A47C 4/54 297/452.41
7,370,379 B2 * 5/2008 Zheng ..... A47C 1/146 297/452.41
7,464,991 B2 * 12/2008 Tinsley-Kim ..... A47C 16/025 297/452.41 X
8,652,081 B2 * 2/2014 Rawlings ..... A61F 5/024 297/464
8,733,833 B2 * 5/2014 Dickinson ..... B60N 2/2809 297/452.41
10,675,959 B2 * 6/2020 Mankame ..... B60J 7/085
11,858,713 B2 * 1/2024 Borrero ..... B65D 81/052
2004/0232756 A1 * 11/2004 Lin ..... B62B 9/10 297/452.41
2005/0099054 A1 * 5/2005 McCarthy ..... A47C 17/045 297/452.41
2005/0269858 A1 * 12/2005 Leutert ..... B64D 11/0647 297/452.41
2006/0046589 A1 * 3/2006 Farley ..... B63H 8/56 441/108
2006/0163935 A1 * 7/2006 Harris ..... A47C 4/54 297/452.41
2009/0051205 A1 * 2/2009 Zheng ..... A47C 4/54 297/452.41
2011/0089741 A1 * 4/2011 Cyr ..... A47C 27/084 297/452.41
2016/0281273 A1 9/2016 Candrian-Bell et al.
2018/0119320 A1 5/2018 Candrian-Bell et al.
2021/0284420 A1 * 9/2021 Borrero ..... B65D 81/052

OTHER PUBLICATIONS

Candrian-Bell, Natalie A et al., "Inflatable Jacquard-Woven Textiles for Structural Applications," U.S. Appl. No. 14/670,201, filed Mar. 26, 2015, 259 pages. File History of U.S. Patent Application Publication #1 (U.S. Pat. No. 20160281273).

* cited by examiner

WOVEN INFLATABLE DEVICES AND METHOD OF MAKING THE SAME

CROSS REFERENCE TO RELATED APPLICATION

The present application is based upon and claims priority under 35 U.S.C. 119(e) to U.S. Provisional Patent Application No. 63/158,451, filed Mar. 9, 2021, entitled WOVEN INFLATABLE DEVICE AND METHOD OF MAKING THE SAME, the entirety of which is hereby incorporated herein by reference for all purposes.

BACKGROUND

Inflatable structures are incorporated into a variety of products including furniture, boats, packaging material, and containers. In a deflated state, these inflatable structures are compact and foldable, while in an inflated state the inflatable structures increase in size and rigidity thereby imparting structural soundness to the products. Despite their widespread use however, these inflatable structures have several disadvantages. The inflatable structures can withstand a limited internal pressure in the inflated state which can lead to insufficient rigidity and a requirement for non-inflatable elements (e.g., rigid supports) to be included in the products. The non-inflatable elements increase weight and decrease foldability of the products, thereby negating some of the advantages of the inflatable structures. Some of these inflatable structures feature an inflatable bladder inside a woven mesh. This configuration limits the bladder, and therefore inflatable structure, to simple shapes. Additionally, these inflatable structures often comprise materials derived from non-renewable resources and/or materials having toxic properties.

SUMMARY

In view of the above issues the present disclosure provides several configurations of inflatable devices, and a method for producing the same. According to one aspect, an inflatable chair is provided that includes a laminated sheet formed in a planar shape and configured to be inflated and folded to transform to a three-dimensional chair shape. The laminated sheet includes a first inflatable region, a first pair of flaps being attached to lateral outside edges of the first inflatable region. The laminated sheet further includes a second inflatable region, a second pair of flaps being attached to lateral outside edges of the second inflatable region. The laminated sheet further includes at least one folding seam between the first inflatable region and the second inflatable region, a seam-crossing passage positioned across the folding seam that enables fluidic communication between the first inflatable region and the second inflatable region, and an air inlet positioned in one of the inflatable regions. The air inlet is configured receive air from an inflator to raise the air pressure inside the first and second inflatable regions, to transform the laminated sheet from the planar shape to the three-dimensional chair shape in an inflated state of between 40 PSI (2.7 bar) and 90 PSI (6.2 bar). In the inflated state, the first and second inflatable regions are configurable such that they are substantially orthogonal to each other, the first inflatable region forming a seating surface and the second inflatable region forming a chair back. Each of the first and second pair of flaps are foldable such to be substantially parallel to each other and such substantially orthogonal to the two inflatable regions. A first flap of the first pair of flaps is configured to couple to a first flap of the second pair of flaps and a second flap of the first pair of flaps is configured to couple to a second flap of the second pair of flaps, to thereby secure the first and second inflatable regions in the three-dimensional chair shape. A flexural modulus of the first inflatable region in an inflated state in a direction parallel to the folding seam exceeds a first predetermined threshold. A flexural modulus of the first inflatable region in an inflated state in a direction perpendicular to the folding seam exceeds a second predetermined threshold.

According to another aspect, an inflatable container is provided, including a laminated sheet formed in a planar shape and configured to be inflated and folded to transform to a three-dimensional polyhedral shape. The laminated sheet includes multiple inflatable regions, a pair of flaps being attached to lateral outside edges of at least a subset of the inflatable regions. The laminated sheet further includes a plurality of folding seams between adjacent inflatable regions, each of the plurality of folding seams having a seam-crossing passage positioned across the folding seam that enables fluidic communication between at least two of the multiple inflatable regions, an air inlet positioned in one of the inflatable regions, and a plurality of fasteners, positioned on at least two of the inflatable regions. Actuation of the air inlet is configured to receive air from an inflator to raise the air pressure inside the multiple inflatable regions, to transform the laminated sheet from the planar shape to the three-dimensional polyhedral shape in an inflated state. In the inflated state, the multiple inflatable regions are configurable such that each of the multiple inflatable regions form a face of the three-dimensional polyhedral shape, the plurality of flaps are foldable such that the flaps overlap with edges of the three-dimensional polyhedral shape that are formed after folding, the plurality of flaps are fastened with the plurality of fasteners to secure the multiple inflatable regions in the polyhedral shape, and a minimum flexural modulus of each of the inflatable regions in an inflated state exceeds a predetermined threshold.

According to another aspect, an inflatable kiteboard harness is provided, including a laminated sheet formed in a planar shape and configured to be inflated and folded to transform to a three-dimensional kiteboard harness shape. The laminated sheet includes multiple inflatable regions including an inflatable central lumbar region, an inflatable right lumbar region, and an inflatable left lumbar region, a pair of flaps being attached to lateral outside edges of at least the inflatable right lumbar region and inflatable left lumbar region, respectively. The laminated sheet further includes a first folding seam between the inflatable left lumbar region and the inflatable central lumbar region, and a second folding seam between the inflatable right lumbar region and the inflatable central lumbar region, each of the first and second folding seams having a seam-crossing passage positioned across the corresponding first or second folding seam that enables fluidic communication across the respective seam. The laminated sheet further includes an air inlet positioned in one of the inflatable regions. The air inlet is configured to receive air from an inflator to raise the air pressure inside the multiple inflatable regions, to transform the laminated sheet from the planar shape to the three-dimensional kiteboard harness shape in an inflated state.

According to another aspect, an inflatable kiteboard harness is provided, including a laminated sheet formed in a planar shape and configured to be inflated and folded to transform to a three-dimensional kiteboard harness shape. The laminated sheet includes an inflatable lumbar region, with a pair of flaps being attached to lateral outside edges of the inflatable lumbar region, respectively. The inflatable lumbar region includes an interior pattern of welded connections connecting a front and a back of the laminated sheet. The laminated sheet further includes an air inlet positioned in the inflatable lumbar region. The air inlet is configured to receive air from an inflator to raise the air pressure inside the inflatable lumbar region, to transform the laminated sheet from the planar shape to the three-dimensional kiteboard harness shape in an inflated state.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

To address the issues discussed above, woven inflatable devices are provided in a variety of configurations. The woven inflatable devices include a woven fabric providing a three-dimensional shape when inflated and a film material coated or laminated on surfaces of the woven fabric. The present disclosure includes example embodiments of the woven inflatable devices as well as methods for producing the embodiments of the woven inflatable device.

Figure 7B:
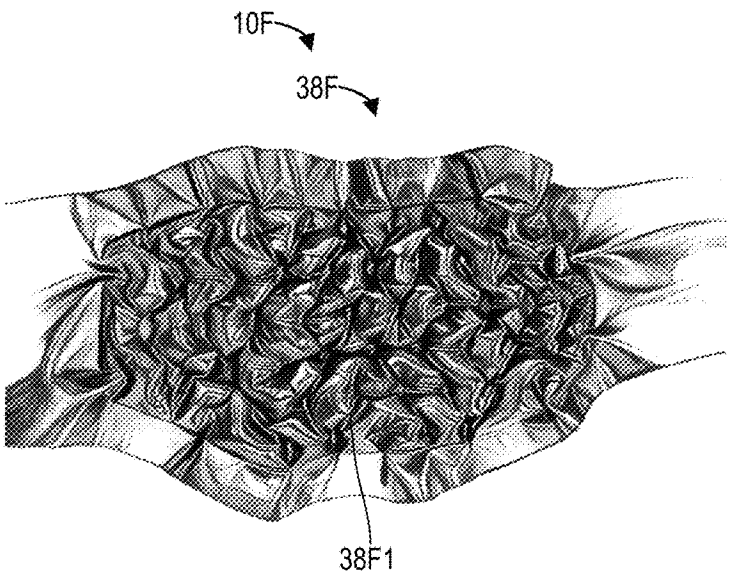
FIGS. 7A and 7B show a sixth embodiment of an inflatable device of the present disclosure in the form of an inflatable kiteboard harness, with inflatable regions having a dimpled structure.
Figure 7A:
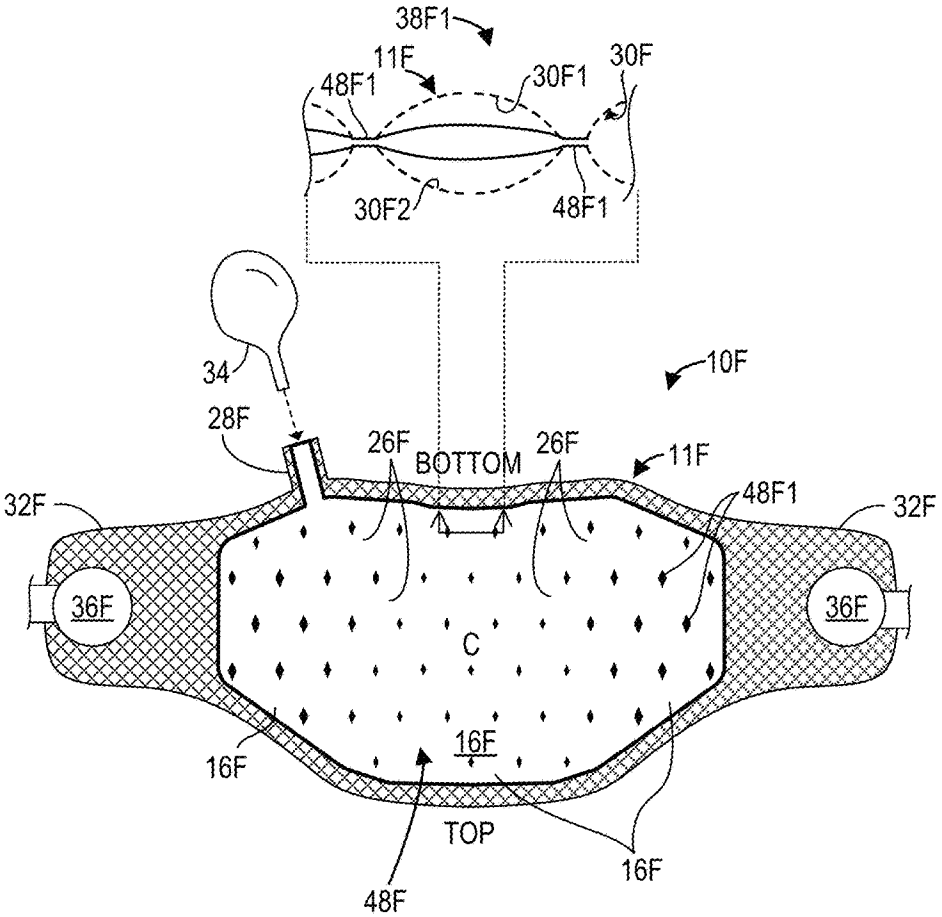

FIGS. 1A-1E show schematic views of an example of a portion of a woven inflatable device 10 made from a laminated sheet 11 with anchoring yarn 12 provided at internal anchoring points 14 to define a shape of an inflatable region 16. The anchoring yarn 12 illustrated in FIGS. 1A-1E can be used in each of the embodiments disclosed herein to define the external shape of the inflatable regions 16 of each embodiment, although the illustrated embodiment of FIGS. 7A and 7B is shown in a configuration that does not include anchoring yarns.

Figure 1C:
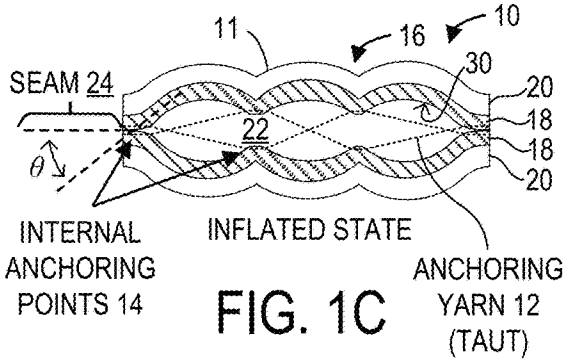
FIGS. 1A-1E show schematic views of an example of a portion of a woven inflatable device with anchoring yarn provided at internal anchoring points to define a shape of an inflatable region, a configuration that may be used in each of the embodiments disclosed herein to define the external shape of the inflatable regions of each embodiment.
Figure 1A:
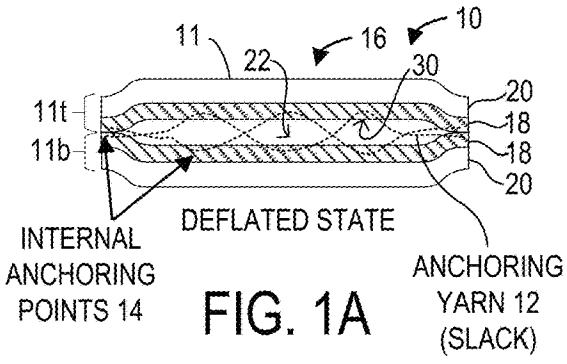
Figure 1D:
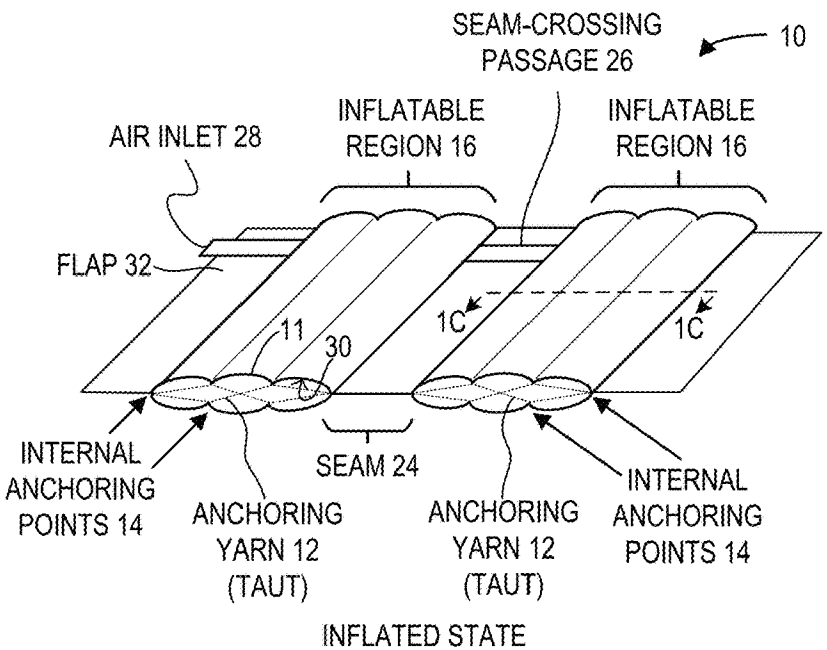
Figure 1B:
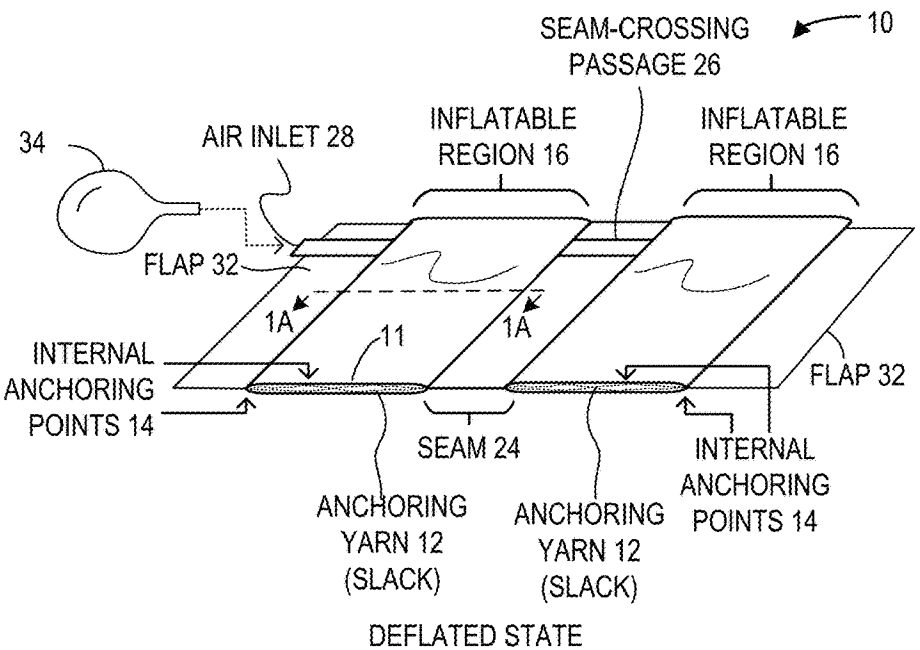
Figure 1E:
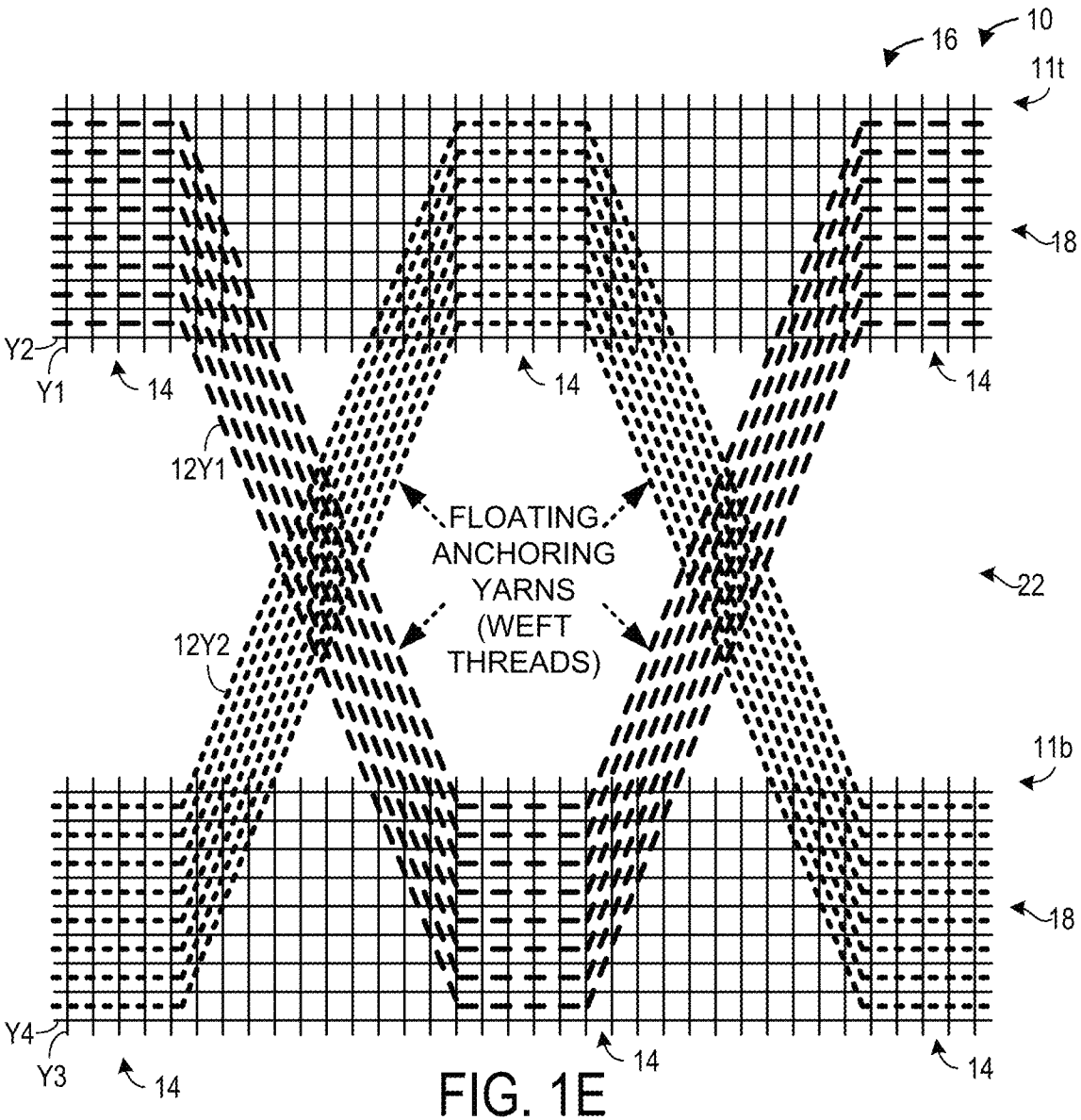
Figure 2A:
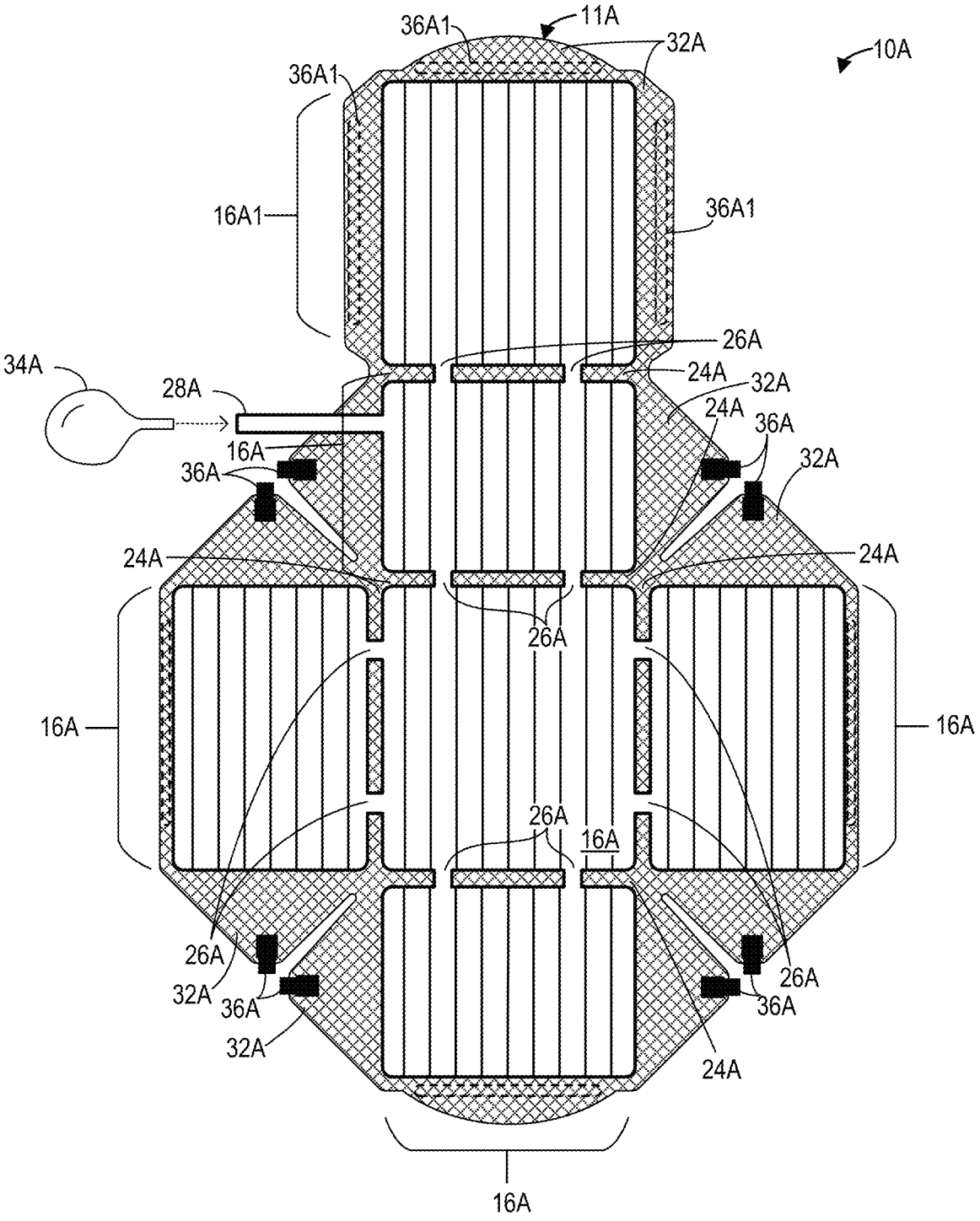
FIGS. 2A-2D show a first embodiment of an inflatable device of the present disclosure in the form of an inflatable container configured as an inflatable cooler.
Figure 2D:
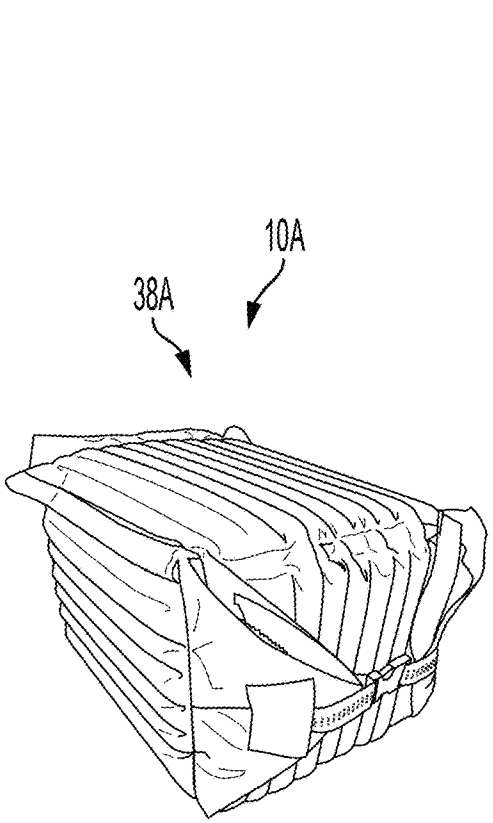
Figure 2C:
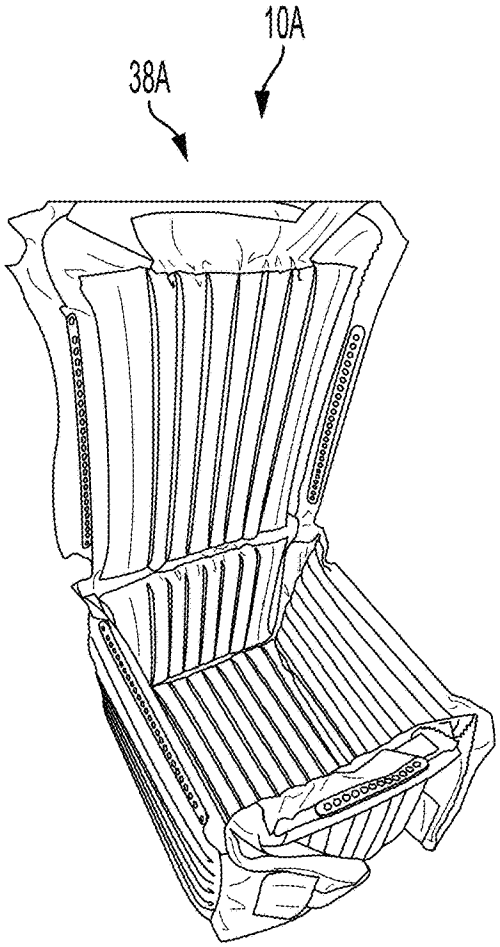
Figure 2B:
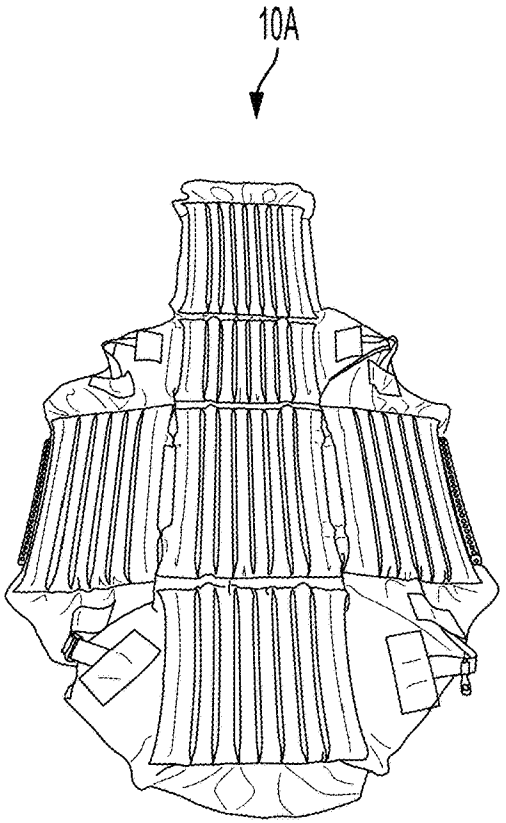

Turning now to FIG. 1A, a cross-section view of a deflated state of an inflatable region 16 is shown, taken along the dashed line indicated in FIG. 1B. In cross section, it can be seen that the laminated sheet 11 includes a top laminated section 11*t* and a bottom laminated section 11*b* separated by a void 22. The laminated sheet 11 is illustrated in a flattened tubular state. An inspection of the cross section of the laminated sheet 11 shows that each of the top laminated section 11*t* and the bottom laminated section 11*b* includes woven fabric 18 covered by an outer layer 20 of plastic film material, which aids in hermetically sealing void 22. In the deflated state, the entirety of the woven inflatable device 10 is substantially planar. Anchoring yarns 12 are provided within the laminated sheet 11. In one example, the anchoring yarns 12 may be incorporated as weft yarns of the woven fabrics 18 at the anchoring points 14, and left to freely float within the void 22 at other locations. Referring briefly to FIG. 1E, woven fabric 18 of the top laminated section 11*t* may be woven from a first warp yarn Y1 and a first weft yarn Y2, and the woven fabric of the bottom laminated section 11*b* may be woven from a second warp yarn Y3 and a second weft yarn Y4 at the same time, by a Jacquard loom, for example. Anchoring yarns 12Y1 and 12Y2 may be alternately incorporated into the weft of the woven fabric layer 18 in the top laminated section 11*t* and the woven fabric 18 layer in the bottom laminated section 11*b* at anchoring points 14. By doing so, the anchoring yarns 12 cross each other within void 22.

FIG. 1B shows a schematic view of the woven inflatable device 10 in a semi-inflated state including a plurality of inflatable regions 16 and a seam 24 separating two of the inflatable regions 16. As ultimately determined by design input into a computerized loom, for example, a weave pattern of the woven fabric 18 in the seam 24 is woven to be tighter than that of the inflatable regions 16. Thus, as air is introduced into the air inlet 28 by an inflator 34, the inflatable regions 16 begin to expand while the seam 24 remains flat or planar. A seam-crossing passage 26 allows fluidic communication between the two inflatable regions 16 such that both inflatable regions 16 are inflatable through one air inlet 28. The inflatable regions 16 have respective anchoring yarns 12 connected at internal anchoring points 14 to an interior surface 30 of the inflatable regions 16, and in some examples the anchoring yarns 12 may be woven as weft threads into the weave of the woven fabric 18 at the anchoring points 14, as described above in relation to FIG. 1E. As the woven inflatable device 10 is in a deflated or semi-inflated state as shown in FIGS. 1A and 1B, the anchoring yarns 12 are relaxed due to being slack rather than taut. In addition to the shape provided by the anchoring yarns 12, flaps 32 are provided by which external structures such as buckles, straps, magnets, etc. can be affixed to the inflatable device 10, to provide additional ability to influence the shape of the inflatable device 10 in the inflated state.

Because the woven inflatable device 10 is configured to be inflated through air inlet 28 to an internal pressure of up to 90 PSI and because the internal pressure of the woven inflatable device is related to its stiffness, the woven inflatable device 10 has a stiffness greater than other devices that cannot tolerate such an internal pressure. The woven inflatable device 10, therefore, has the potential technical benefit of being stronger, lighter, and more structurally sound than other inflatable devices of similar size.

Turning now to FIGS. 1C and 1D, the woven inflatable device 10 is shown in the inflated state. Sufficient air is introduced through the air inlet 28 such that the anchoring yarns 12 are straight, in tension. As more air is introduced through the air inlet 28, the anchoring yarns 12 restrict further changes in a shape of the woven inflatable device 10, and an internal pressure increases causing an increase in firmness and rigidity of the woven inflatable device 10. It will be appreciated that only two anchoring yarns 12 are shown for clarity in FIGS. 1A-1D, but in practice an inflatable region 16 may have multiple anchoring yarns 12, for example dozens, hundreds, or thousands.

FIG. 1C shows a cross section of an inflatable region 16 of the woven inflatable device 10 in the inflated state, taken along the dashed line in FIG. 1D. While the internal anchoring points 14 are depicted as formed equally spaced apart rows, it will be appreciated that the internal anchoring points 14 may be at virtually any point (any xyz coordinate) on the interior surface 30 of the inflatable region 16. Thus, although the anchoring yarns 12 are shown as formed to create a parallel pattern of inflated tubes in FIG. 1D, other patterns are also possible. Although the anchoring yarns are depicted as crossing in the x-y plane in cross section in FIG. 1C, it will be appreciated that the anchoring yarns may be crossed in the x-z plane, the y-z plane, or any other plane. In another embodiment, during weaving the anchoring yarns 12 are configured such that the seam 24 and a tangent line (shown as a dashed line in FIG. 1C) of the inflatable region are oblique to one another forming an oblique connection when the woven inflatable device 10 is in the inflated state and the anchoring yarns 12 are taut. Alternatively, during weaving the anchoring yarns can be configured such that angle θ formed between the seam and the tangent line of the laminated sheet 11 of the inflatable region 16 are orthogonal to one another forming an orthogonal connection where they meet, when the woven inflatable device 10 is in the inflated state.

It will be appreciated that the configurations depicted in FIGS. 1A-1E are only intended to introduce certain components of the woven inflatable device 10, in particular the anchoring yarns 12 and seam crossing passage 26, and are not representative of the entire scope of the woven inflatable device 10. Rather, it should be understood that the anchoring yarns 12, seam crossing passage 26, and other aspects of the woven inflatable device 10 of FIGS. 1A-1E can be incorporated into any of the other embodiments depicted herein. The following examples are embodiments of the woven inflatable device 10 directed toward a variety of applications.

Turning generally to FIGS. 2A-4B, illustrations of the woven inflatable device 10 configured to be inflatable containers 10A-10C are provided. Turning now to FIGS. 2A-2D, illustrations of the woven inflatable device 10 configured to be an inflatable cooler 10A are provided. The inflatable cooler 10A comprises a laminated sheet 11A formed in a planar shape and configured to be inflated and folded to transform to a three-dimensional polyhedral shape, with substantially flat faces. The laminated sheet 11A includes multiple inflatable regions 16A, a pair of flaps 32A being attached to lateral outside edges of at least a subset of the inflatable regions 16A. The inflatable regions 16A are formed to be substantially planar when inflated. The laminated sheet 11A further includes a plurality of folding seams 24A between adjacent inflatable regions, each of the plurality of folding seams 24A having a seam-crossing passage 26A positioned across the folding seam that enables fluidic communication between at least two of the multiple inflatable regions 16A. The laminated sheet further includes an air inlet 28A positioned in one of the inflatable regions 16A and extending through a flap 32A to reach the inflatable region 16A, an inflator 34A selectively coupled to the air inlet, and a plurality of fasteners 36A, positioned on at least two of the inflatable regions. The air inlet is configured to receive air from the inflator 34A to raise the air pressure inside the multiple inflatable regions 16, to transform the laminated sheet 11A to the three-dimensional polyhedral shape in an inflated state. The inflator 34A is configured to raise the air pressure inside the inflatable regions to between about 40 PSI and 90 PSI. The air inlet includes a valve, and in the inflated state, the valve of the air inlet is configured to close and maintain the internal pressure of the first and second inflatable regions between 40 PSI and 90 PSI. At these pressures, the inflatable container in the form of inflatable cooler 10A can support a vertical load of at least 250 lbs placed on top of a lid of the inflatable container in the form of inflatable cooler 10A. In the inflated state, the multiple inflatable regions 16A are configurable such that each of the multiple inflatable regions 16A form a substantially planar face of the three-dimensional polyhedral shape, the plurality of flaps are foldable such that the flaps overlap with edges of the three-dimensional polyhedral shape 38A that are formed after folding, the plurality of flaps are fastened with the plurality of fasteners 36A to secure the multiple inflatable regions 16A in the polyhedral shape, and a minimum flexural modulus of each of the inflatable regions 16A in an inflated state exceeds a predetermined threshold. The flexural modulus may be within the following exemplary ranges. The flexural modulus in a typical range is 3.25 MPa to 5.5 MPa, and is more preferably 3.75 MPa to 5.0 MPa, and even more preferably 4 MPa to 4.5 MPa and in one particular example is 4 MPa. The predetermined threshold for the minimum flexural modulus discussed above, therefore, may be 3.25 MPa, 3.75 MPa, or 4 MPa, in different configurations, as some examples.

In the example of FIGS. 2A-2D, the polyhedral shape is a rectangular polyhedron, however the inflatable cooler can be configured such that the polyhedral shape is a triangular polyhedron, a pentagonal polyhedron, a hexagonal polyhedron, or any other type of polyhedron. Alternatively, the inflatable cooler may have a cylindrical shape, a dome shape, or other shape.

In order to contain liquids or melting ice, for example, the inflatable cooler 10A is configured such that at least a subset of the inflatable regions 16A form a water-tight container. As shown in the example of FIGS. 2A-2D, the inflatable cooler has five inflatable regions 16A forming a body of the inflatable cooler 10A and one inflatable region 16A1 forming a lid of the inflatable cooler. On a lower part of the inflatable cooler 10A, the fasteners 36A are buckles and secure sides of the inflatable cooler 10A, and on an upper part of the inflatable cooler 10A the fasteners 36A are magnetic fasteners 36A1 and secure the lid formed by inflatable region 16A1 of the inflatable cooler. In this configuration, the internal pressure within the void of the laminated sheet 11A of the inflatable cooler 10A is 40-90 PSI, and the inflatable cooler 10A can support a vertical load of at least 250 lbs placed on top of the lid of the inflatable cooler 10A. Because the inflatable cooler 10A supports such a vertical load, the inflatable cooler 10A can serve as a seat for a user.

Figure 3B:
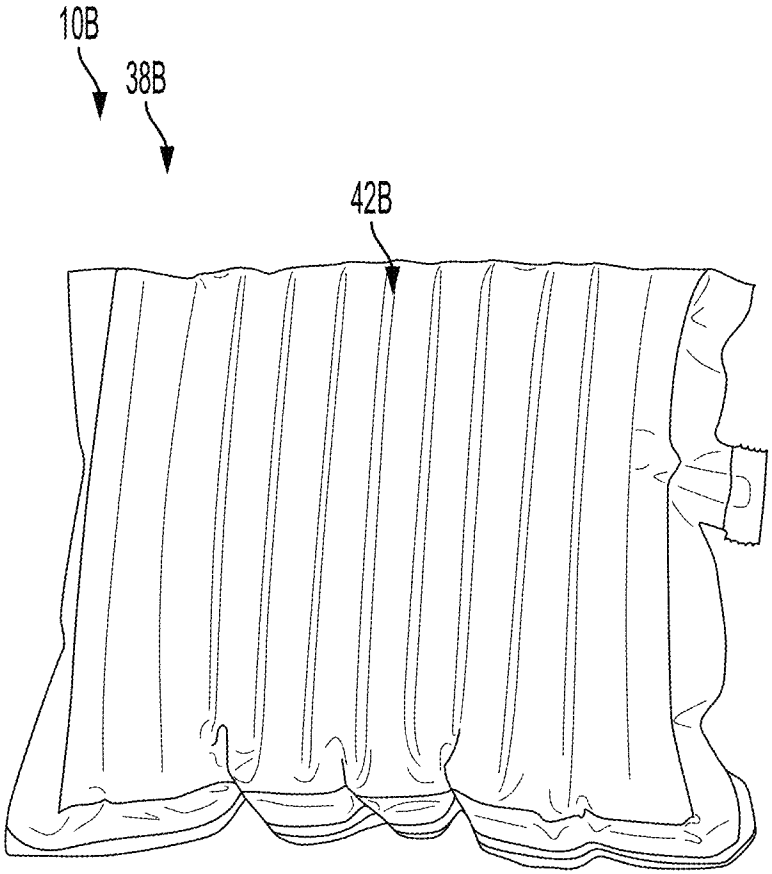
FIGS. 3A and 3B show a second embodiment of an inflatable device of the present disclosure in the form of an inflatable container configured as an inflatable envelope.
Figure 3A:
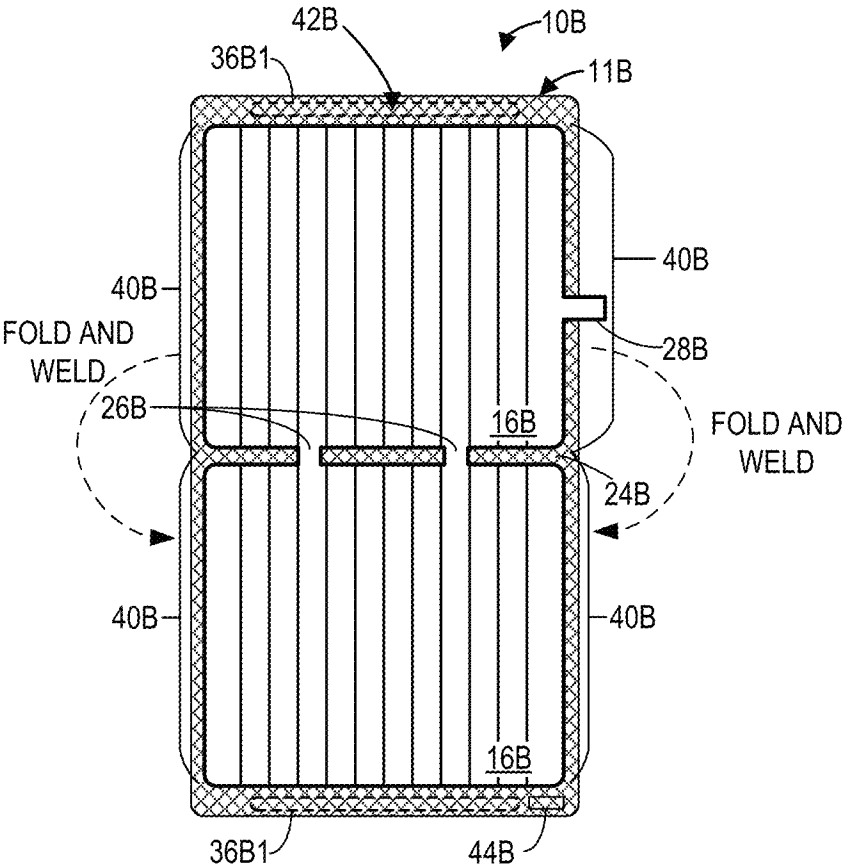

FIGS. 3A and 3B show a second embodiment of the inflatable device 10 in the form of an inflatable container configured as an inflatable envelope 10B. The inflatable envelope 10B comprises a laminated sheet 11B formed in a planar shape and configured to be folded along seam 24B, such that edges 40B are may be affixed to each other for example by plastic welding to form an envelope shape with an opening 42B provided at one end. The opening 42B may be selectively opened and closed via a pair of fasteners 36B1 positioned around the mount of the opening 42B, which may be snaps, magnets, etc. Alternatively, a zipper or other fastener may be used. By inflating the envelope through air inlet 28B the flat, folded and welded planar shape can be transformed to an envelope shape 38B, with air passing through seam crossing passages 26B. The inflatable envelope 10B is configured such that it accepts an item and is inflatable to thereby secure the item within the inflatable envelope. In one embodiment (not shown), the inflatable envelope 10B has more than one separate inflatable region 16B that is not in fluid communication with other inflatable regions 16B. For example, the seam crossing passages 26B may be omitted and the separate inflatable regions 16B may each be outfitted with a respective air inlet 28B and valve so that the separate inflatable regions 16B are individually inflatable, thereby accommodating items of varying shapes and sizes. Because the inflatable envelope 10B is highly resilient, no additional packaging (boxes, padding, etc.) is needed to ship the item. Thus, the inflatable envelope 10B functions as an inflatable shipping envelope. A Radio Frequency Identification (RFID) 44B tag configured to emit a signal containing a unique identifier upon being interrogated by an interrogation signal is included in the inflatable envelope 10B such that it is trackable without a shipping label, for example. The valves of the inflatable envelope 10B are configured such that the inflatable envelope 10B is capable of being deflated and/or reinflated such that another item is accommodated. Thus, the inflatable envelope 10B can be reused hundreds or thousands of times, decreasing the impact of the consumption of single-use plastics of conventional shipping envelopes on the environment. As described above, the yarns and film material of the inflatable envelope are recyclable such that they may be recovered and incorporated into a new woven inflatable device.

Figure 4B:
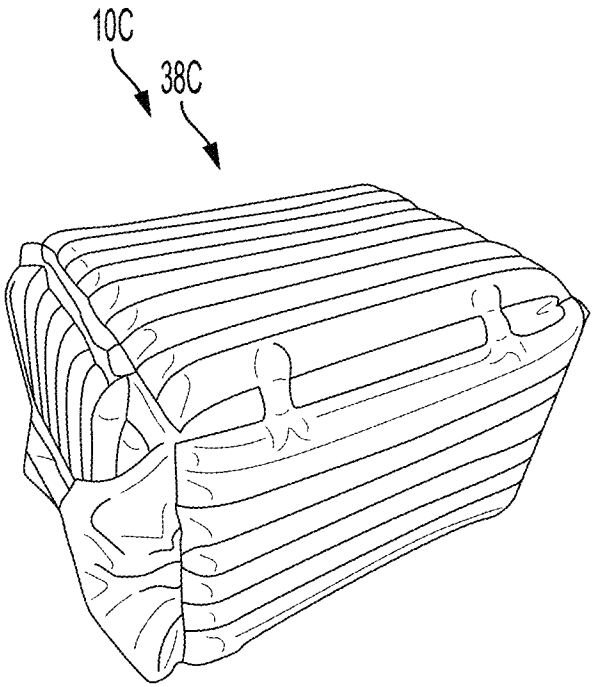
FIGS. 4A and 4B show a third embodiment of an inflatable device of the present disclosure in the form of an inflatable container configured as an inflatable box.
Figure 4A:
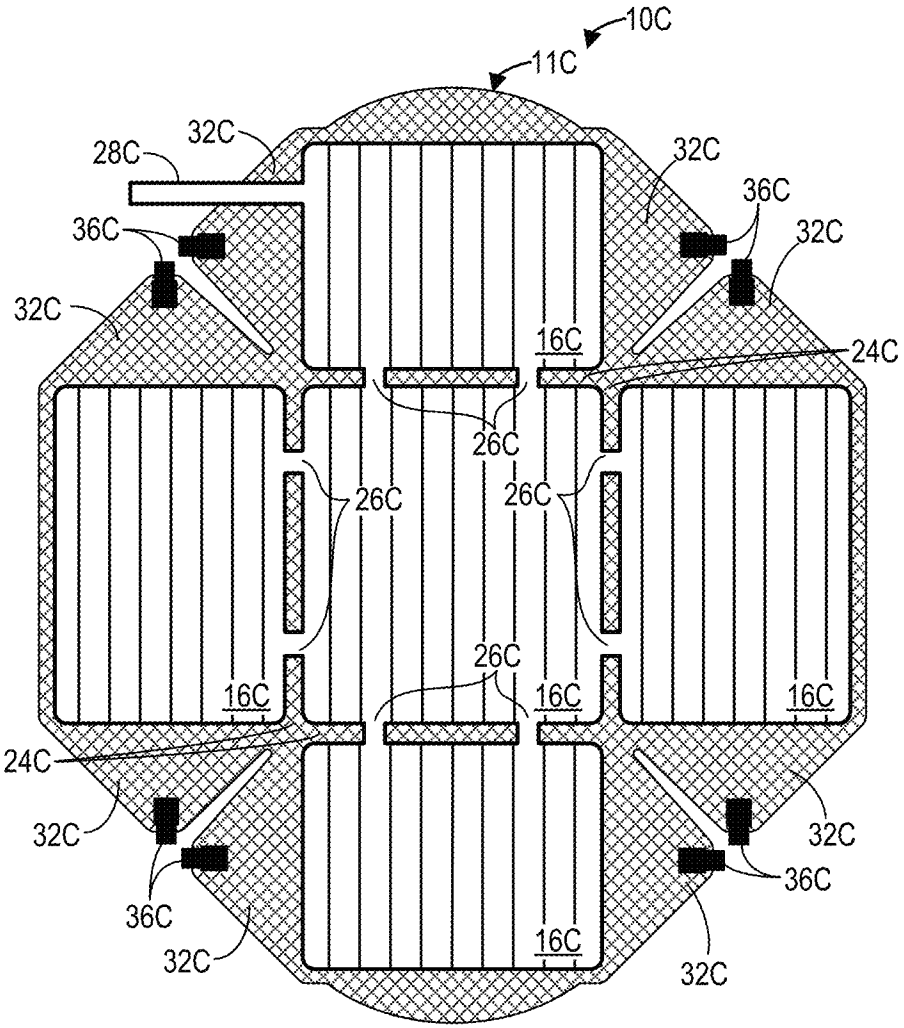

FIGS. 4A and 4B show a third embodiment of inflatable device 10 in the form of an inflatable container configured as an inflatable box 10C. The inflatable box 10C comprises a laminated sheet 11C formed in a planar shape and configured to be inflated and folded to transform to a box shape 38C. Four inflatable regions 16C are joined at seams 24C with seam crossing passages 26C fludicially communicating the inflatable regions 16C so that inflation by air inlet 28C results in all inflatable regions 16C being inflated. Fasteners 36C are provided on flaps 32C, to enable the flaps to be secured to each other to transform the planar laminar sheet 11C into a box shape 38C when inflated and when the fasteners 36C are secured to each other. It will be appreciated that the box shape 38C has only 5 sides, and is open on one side. Optionally, a lid may be provided, similar to the inflatable cooler 10A above. If desired, two inflatable boxes 10C of slightly different sizes may be slid together to provide a top box shape and bottom box shape that fits within the top box shape (or vice versa) to thereby protect a cargo space with the inflatable boxes 10C from all sides.

Advantages of the inflatable containers 10A-10C are that they are substantially flat in the deflated state for convenient storage or shipping, and in the deflated state can be rolled up for compact storage if desired. In the inflated state, the inflatable containers 10A-10C provide padding to protect any contents of the containers. Because the inflatable containers 10A-10C are inflated with air, no additional weight is required to provide padding. Additionally, the inflatable containers 10A-10C are configured to operate in a pressure range of 40-90 PSI, thereby providing a range of firmness and a range of rigidity to the inflatable containers. Additionally, the design input can be modified to produce containers of different sizes and shapes so that items of various size and shape can be securely contained.

Figure 5B:
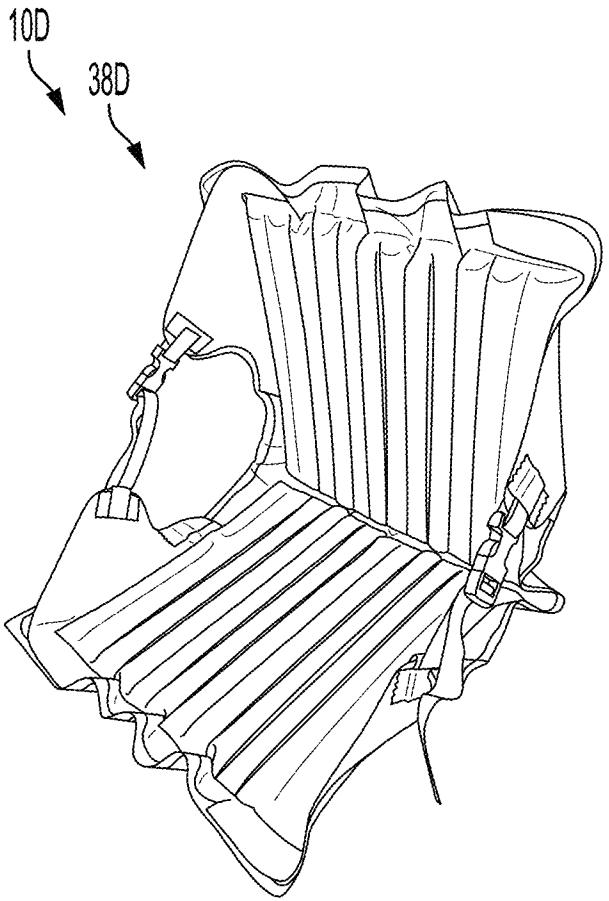
FIGS. 5A and 5B show a fourth embodiment of an inflatable device of the present disclosure in the form of an inflatable chair.
Figure 5A:
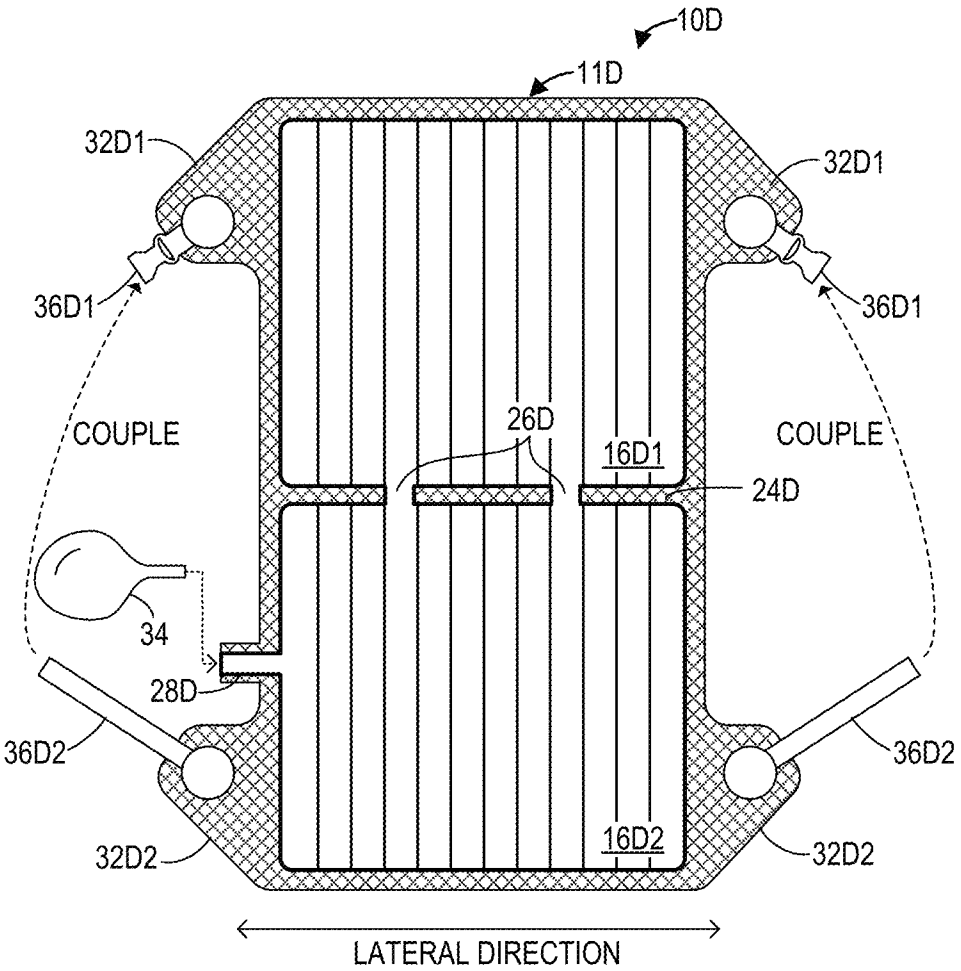

Turning now to FIGS. 5A and 5B, illustrations of the woven inflatable device 10 configured to be an inflatable chair 10D are provided. The inflatable chair 10D includes a laminated sheet 11D formed in a planar shape and configured to be inflated and folded to transform to a three-dimensional chair shape 38D. Like inflatable cooler 10A, envelope 10B, and box 10C, the laminated sheet 11D includes a woven inner layer 18 formed from woven fabric and an air-tight laminated outer layer r 20 formed from plastic film material, as described in relation to FIG. 1A and discussed in the method description below. The laminated sheet 11D includes a first inflatable region 16D1 and a first pair of flaps 32D1 attached to lateral outside edges of the first inflatable region 16D1. The laminated sheet 11D further includes a second inflatable region 16D2 and a second pair of flaps 32D2 being attached to lateral outside edges of the second inflatable region 16D2. Each of the flaps 32D1 and 32D2 includes a corresponding fastener 36D1, 36D2. The laminated sheet 11D further includes at least one folding seam 24D between the first inflatable region 16D1 and the second inflatable region 16D2, and a seam-crossing passage 26D positioned across the folding seam 24D that enables fluidic communication between the first inflatable region 16D1 and the second inflatable region 16D2. The laminated sheet 11D further includes an air inlet 28D positioned in one of the inflatable regions 16D1, 16D2 and an inflator 34 selectively coupled to the air inlet 28D. The air inlet is configured to receive air from an inflator 34 to raise the air pressure inside the first and second inflatable regions 16D1, 16D2, to transform the laminated sheet 11D from the planar shape to the three-dimensional chair shape 38D in an inflated state of between 40 PSI (2.7 bar) and 90 PSI (6.2 bar). The air inlet 28D may include a valve, and in the inflated state the valve of the air inlet 28D is configured to close and maintain the internal pressure of the first and second inflatable regions between 40 PSI and 90 PSI. While only one air inlet 28D is shown, it will be appreciated that seam crossing passages 26D may be omitted and separate air inlets 28D may be provided for each of the first and second inflatable regions 16D1, 16D2, if desired.

In the inflated state, the first and second inflatable regions 16D1, 16D2 are configurable such that they are substantially orthogonal to each other, with the first inflatable region 16D1 forming a seating surface and the second inflatable region 16D2 forming a chair back. In the inflated state, each of the first and second pair of flaps 32D1, 32D2 are foldable such to be substantially parallel to each other and such substantially orthogonal to the two inflatable regions 16D1, 16D2. In the inflated state, a first flap of the first pair of flaps 32D1 is configured to couple to a first flap of the second pair of flaps 32D2 and a second flap of the first pair of flaps 32D1 is configured to couple to a second flap of the second pair of flaps 32D2 via the corresponding pair of fasteners 36D1, 36D2, to thereby secure the first and second inflatable regions 16D1, 16D2 in the three-dimensional chair shape 38D. Thus, each of the flaps 32D1, 32D1 includes a corresponding fastener 36D1, 36D2, and the first flap of the first pair of flaps 32D1 is configured to couple to the first flap of the second pair of flaps 32D2 via corresponding fasteners 36D1, 36D2 from each of the first flaps, and the second flap of the first pair of flaps 32D1 is configured to couple to the second flap of the second pair of flaps 32D2 via corresponding fasteners 36D2 from each of the second flaps.

In the inflated state, a flexural modulus of the first inflatable region 16D1 in in a direction parallel to the folding seam 34D exceeds a first predetermined threshold, and a flexural modulus of the first inflatable region 16D1 in a direction perpendicular to the folding seam 34D exceeds a second predetermined threshold. In one embodiment, the flexural modulus of the first inflatable region 16D1 in a direction parallel to the folding seam may be set to be within the following ranges. The flexural modulus in a typical range is 3.25 MPa to 5.5 MPa, and is more preferably 3.75 MPa to 5.0 MPa, and even more preferably 4 MPa to 4.5 MPa and in one particular example is 4 MPa. Thus, the first predetermined threshold may be set to be 3.25 MPa, 3.75 MPa, or 4 MPa, for example. Further, the flexural modulus of the first inflatable region 16D1 in the perpendicular direction to the seam 34D may be above a second predetermined threshold that is lower than these values for the first predetermined threshold.

As shown in FIGS. 5A and 5B, the flaps 34D1, 34D2 are formed from the laminated sheet 11D. This configuration provides simple construction by allowing the flaps 34D1, 34D2 to be included in the design input rather than being additional parts added after laminating.

An advantage of the inflatable chair 10D is that in a deflated state, the laminated sheet 11D can be very thin. In one example, the laminated sheet 11D has a thickness between 1 mm and 6 mm, however the laminated sheet 11D may alternatively be thinner or thicker. Also, like the other embodiments described herein, the inflatable chair 10D is foldable and rollable along an axis defined by any two points on a surface of the inflatable chair 10D. This provides advantages over chairs having non-inflatable parts, as those chairs are significantly less foldable and rollable, if at all.

FIGS. 6A-7B illustrate embodiments of inflatable device 10 configured as kiteboard harnesses 10E, 10F. Turning now to FIGS. 6A-6D, a fifth embodiment of an inflatable device 10 of the present disclosure in the form of an inflatable kiteboard harness 10E is illustrated, with inflatable regions 16E having a vertical semi-tubular design. The inflatable kiteboard harness 10E includes a laminated sheet 11E having layers of woven fabric 18E and an outer layer 20E of a plastic film. The laminated sheet 11E is formed in a planar shape and configured to be inflated to transform from the planar shape to a three-dimensional kiteboard harness shape 38E. The laminated sheet 11E includes multiple inflatable regions 16E including an inflatable central lumbar region 16E1, an inflatable right lumbar region 16E2, and an inflatable left lumbar region 16E3, with a pair of flaps 32E attached to lateral outside edges of at least the inflatable right lumbar region 16E1 and inflatable left lumbar region, respectively. The inflatable kiteboard harness 10E further includes a first folding seam 24E1 between the inflatable left lumbar region 16E3 and the inflatable central lumbar region 16E1, and a second folding seam 24E2 between the inflatable right lumbar region 16E2 and the inflatable central lumbar region 16E1, each of the first and second folding seams 24E1, 24E2 having a seam-crossing passage 26E positioned across the corresponding first or second folding seam 24E1, 24E2 that enables fluidic communication across the respective seam 24E1, 24E2. The inflatable kiteboard harness 10E further includes an air inlet 28E positioned in one of the inflatable regions 16E. The air inlet 28E is configured to receive air from an inflator 34 to raise the air pressure inside the multiple inflatable regions 16E, to transform the laminated sheet 11E from the planar shape to the three-dimensional kiteboard harness shape 38E in an inflated state. As illustrated, the inflator 34 may be selectively coupled to the air inlet 28E. Alternatively, in this and other embodiments described herein, the inflator 34 may be permanently or semi-permanently attached to the air inlet 28E, which can promote a stronger seal and prevent loss or damage to the inflator 34.

Each of the multiple inflatable regions 16E includes anchoring point seams 46E along which anchoring points 14E are formed. Typically the anchoring points 14E are formed substantially continuously along the anchoring point seams 46E, although spaces or gaps between anchoring points 14E along the anchoring point seams 16E may be provided in some embodiments. It will be appreciated that the anchoring point seams 46E do not connect the top laminated section 11Et and bottom laminated section 11Eb of the laminated sheet 11E directly, but rather serve as seams at which the anchoring yarns 12E are respectively woven into the woven fabric 18E of each of the top and bottom laminated sections 11Et, 11Eb of the laminated sheet 11E. Typically, a vertical gap G2 is maintained between the interior front (top) surface 30E1 and the interior back (bottom) surface 30E2 in the inflated state. As shown in FIG. 6A, the anchoring point seams 46E are formed vertically, and parallel to each other in a vertical linear pattern that is reproduced in a pronounced form in the inflated state shown in FIG. 6B.

Figure 6C:
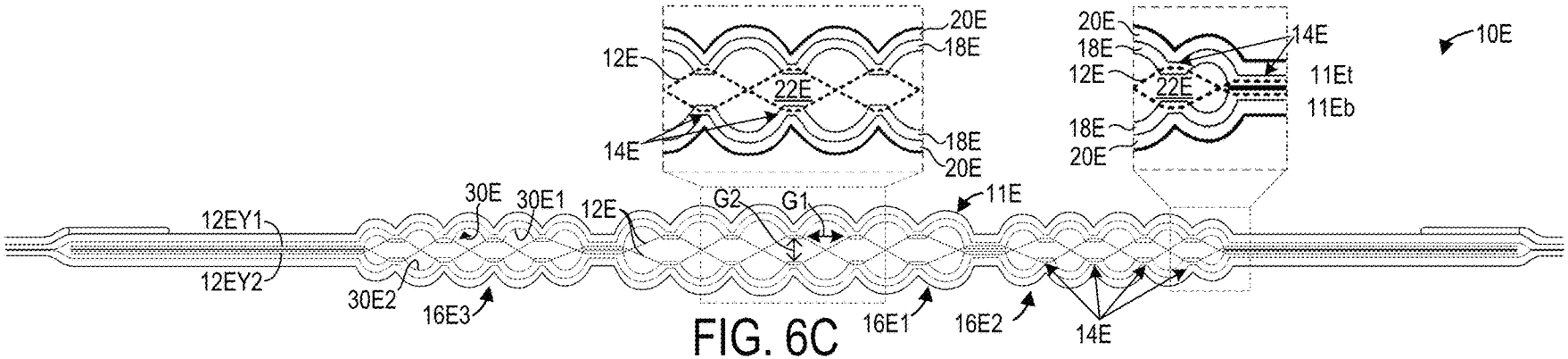
FIGS. 6A-6D show a fifth embodiment of an inflatable device of the present disclosure in the form of an inflatable kiteboard harness, with inflatable regions having a vertical tubular design.
Figure 6B:
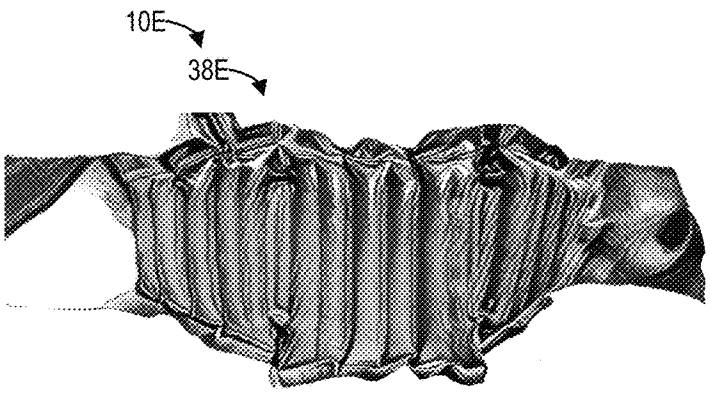
Figure 6A:
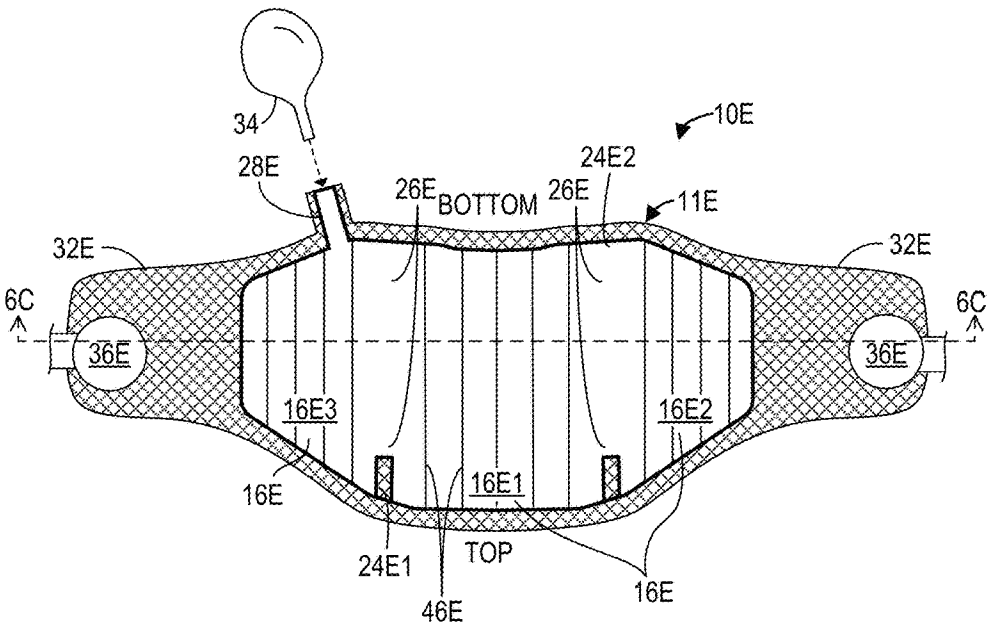

As shown in the cross sectional view of FIG. 6C, each of the multiple inflatable regions 16E1-16E3 includes a plurality of interior anchoring yarns 12E alternately stretching from anchoring points 14E on the interior front surface 30E1 to anchoring points 14E on the interior back surface 30E2 of the interior surface 30E of the laminated sheet 11E. The anchoring points 14E are spaced apart by horizontal gaps G1 as viewed in cross section. The anchoring yarns 12E cross each other a plurality of times in the void 22E of the laminated sheet in a repeating crossing pattern, when the laminated sheet is in the inflated state. Thus, the crossing pattern includes multiple crossing points in the void 22E of the laminated sheet 11E, as viewed in a side view. The anchoring yarns 12E include a first anchoring yarn 12EY1 that begins in the top laminated sheet section 11Et and proceeds to the bottom laminated sheet section 11Eb and repeats this pattern, and a second anchoring yarn 12EY2 that begins on the bottom laminated sheet 11Eb and proceeds to the top laminated sheet 11Et, and then repeats this pattern. The anchoring yarns 12E are configured, when the inflatable regions 16E are inflated, to be stretched taut, as shown in dashed lines, and define the three-dimensional kiteboard harness shape 38E for each of the multiple inflatable regions 16E1-16E3 in the inflated state.

Figure 6D:
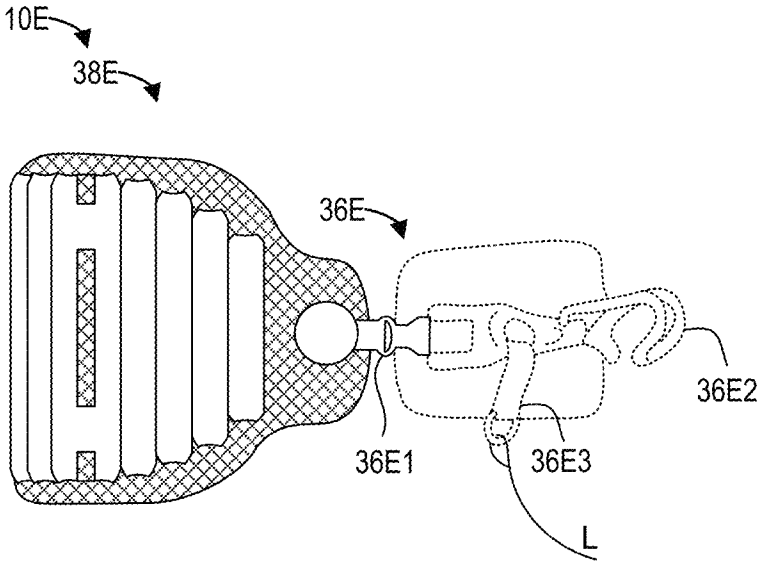

The inflatable kiteboard harness 10E further includes a respective fastener 36E in the form of anterior belt member shown schematically coupled to each of the flaps 32E. As shown in FIG. 6D, each anterior belt member includes an adjustable strap 36E1 configured to vary the length of the belt member 36E, a hook 36E2 configured to engage with a chicken loop of a kiteboard tether, and/or a leash L coupled by a leash release mechanism 36E3.

Turning now to FIGS. 7A-7B, a sixth embodiment of an inflatable device 10 of the present disclosure in the form of an inflatable kiteboard harness 10F is illustrated, with an inflatable region 16F having a dimpled structure. The inflatable kiteboard harness 10F includes a laminated sheet 11F formed in a planar shape and configured to be inflated to transform from the planar shape to a three-dimensional kiteboard harness shape 38F. The inflatable region with the dimpled structure covers a central lumbar region and right and left lumbar regions of a user, in the depicted embodiment, and thus may be referred to as an inflatable lumbar region 16F. The laminated sheet 10F includes the inflatable lumbar region 16F, and a pair of flaps 32F being attached to lateral outside edges of the inflatable lumbar region 16F, respectively. Each flap 32F has a fastener 36F in the form of an anterior belt of the type described above attached thereto. The inflatable lumbar region 16F includes an interior pattern 48F of welded connections 48F1 connecting a front (e.g., front interior surface 30F1) and a back (e.g., back interior surface 30F2) of the interior surface 30F of the laminated sheet 11F, which are the top and bottom of the sheet 11F in the cross-sectional view of FIG. 7A. Passages 26F are provided between the welded connections 48F1 to allow fluidic communication throughout the interior of the inflatable region 16F around the welded connections 48F1. The inflatable kiteboard harness further includes an air inlet 28F positioned the inflatable region. The air inlet 28F is configured to receive air from an inflator 34 to raise the air pressure inside the inflatable region 16F, to transform the laminated sheet 11F to the three-dimensional kiteboard harness shape 38F in an inflated state. In the depicted embodiment of FIG. 7A, the pattern of the welded connections 48F1 is a dot pattern, which is symmetric, with the widths of the welded connections 48F1 increasing with their distance from a center C of the lumbar region 16F. The dot pattern imparts a dimpled surface 38F1 to the inflatable region 16F in the inflated state, as shown in FIG. 7B. As shown in the magnified cross section of FIG. 7A, the dimpled surface is formed by the welded connections 48F1, which cause the front and back interior surfaces 30F1, 30F2 to join at specific locations. The inflated state is the state in which the dimpled surface 38F1 forms. The dimpled surface 38F1 provides a comfortable distribution of forces against the lumbar region of a user of the inflatable kiteboarding harness 10F. It will be appreciated that no anchoring yarns 12 are featured in this embodiment, although optionally such anchoring yarns 12 may be provided, if desired.

Figure 8:
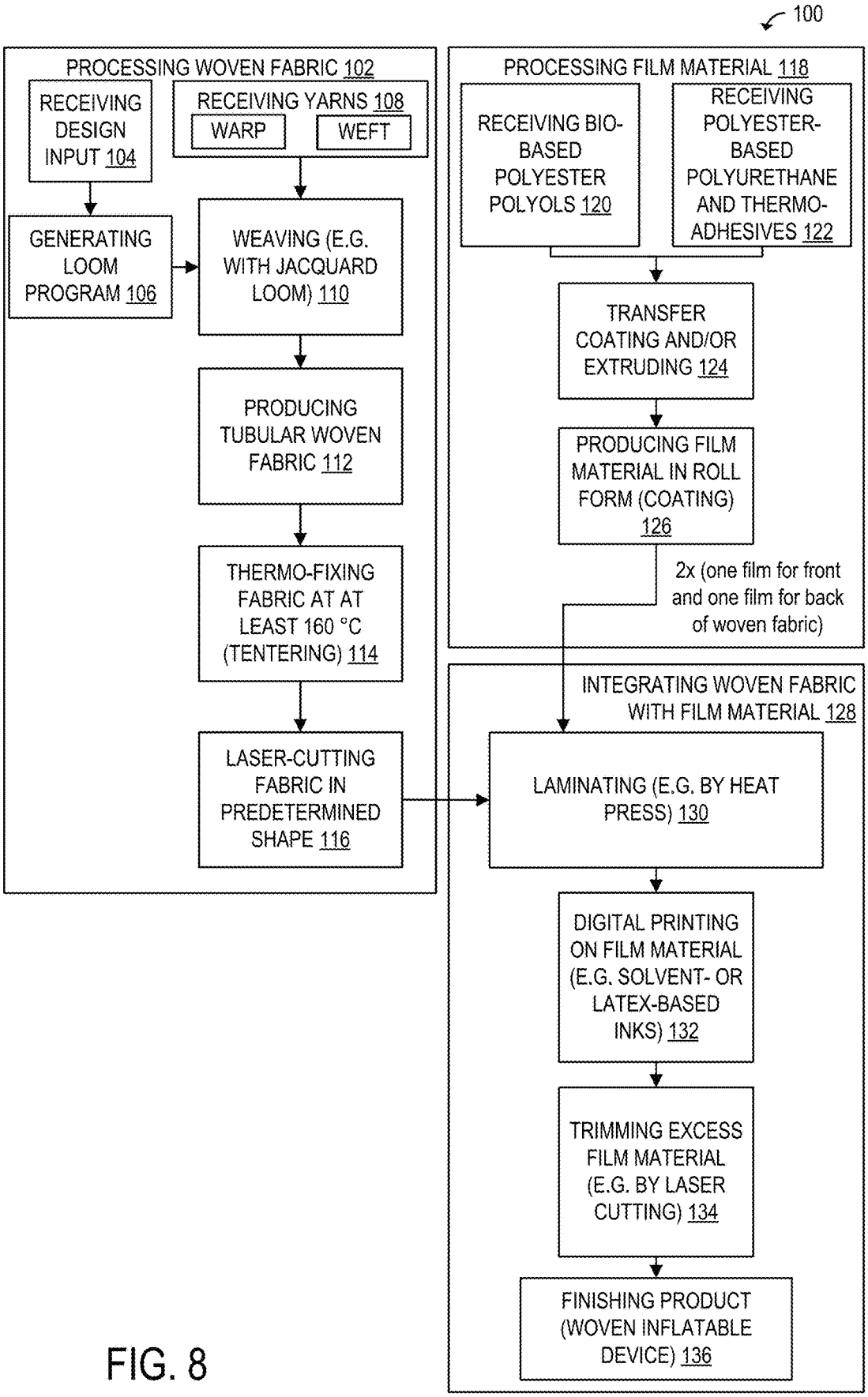
FIG. 8 illustrates a method for producing a woven inflatable device, according to one embodiment of the present disclosure.

Turing now to FIG. 8, a process flow illustrating a method 100 for producing the woven inflatable device is provided. Generally, the method 100 includes at 102 processing the woven fabric, at 118 processing the film material, and at 128 integrating the woven fabric with the film material. Additional steps of the method 100 are will now be explained. At 104, the method 100 includes receiving a design input. The design input is two-dimensional and in the form of a vector file, image file, or other suitable file type. The design input includes weave patterns and functional weaves that define one or more regions of the woven inflatable device. Some of the regions are inflatable regions which are substantially two-dimensional in a deflated state and three-dimensional in an inflated state. One example of a functional weave resulting in an inflatable region is a pocket tubular weave which results in a flat shape in a deflated state and a three-dimensional tubular structure in an inflated state. Other regions are noninflatable and substantially two-dimensional in both the inflated and deflated states. Examples of such regions are flaps, seams between inflatable regions, and edges/borders of the inflatable device. A diamond weave may be used for the flaps, whereas a strength weave or tight weave may be used for the seams/borders of the woven inflatable device.

At 106, the method 100 includes generating a loom program. In this step, the design input is translated by a computer application into the loom program which is received by a loom (e.g., a Jacquard loom). At 108, the method 100 includes receiving yarns including a warp yarn and a weft yarn. At 110, the method 100 includes weaving the warp yarn and the weft yarn. At 112, the method 100 includes producing a woven fabric. The woven fabric may be tubular, flat, or the woven fabric may have at least one tubular region and at least one flat region.

At 114, the method includes tentering or heatsetting. In this step, the woven fabric held in tension along one or two axes and heated for a predetermined temperature and a predetermined time.

For example, the predetermined temperature may be 160° C., 170° C., 180° C., or any other suitable temperature. The predetermined time may be between 20 to 50 seconds depending on the fabric thickness. After tentering, the yarns of the woven fabric are fixed such that they do not stretch under tension and do not shrink during the film application process. This provides structural integrity and a constant size of the woven inflatable device in the inflated state.

At 116, the method 100 includes laser cutting the woven fabric into a predetermined shape. The predetermined shape is included in the above-described design input. Laser cutting may remove loose ends remaining after weaving and/or provides shapes difficult to achieve with weaving alone. Additionally or alternatively, laser cutting can separate the woven fabric in a scenario in which the design input includes predetermined shapes for more than one woven inflatable device. For example, a typical Jacquard loom may produce a woven fabric having a width of 1.5 meters and a length limited only by the length of yarns received by the Jacquard loom. For woven inflatable devices having a dimension less than 1.5 meters, it can be more efficient to weave more than one at time and separate the woven fabric by laser cutting. While this example uses laser cutting, it will be appreciated that other methods of cutting may be used. The woven fabric may be cut for example by ultrasonic cutting, hot blade cutting, scissors, or any other suitable cutting method.

At 118, the method 100 includes processing film material. Raw materials used in this step are preferably derived from renewable resources and preferably do not have toxic properties. For example, at 120, the method 100 includes receiving bio-based polyester polyols. At 122, the method 100 includes receiving polyester-based polyurethane and thermo-adhesives. At 124, the method 100 includes transfer coating and/or extruding. At 126, the method includes producing film material in roll form.

At 128, the method 100 includes integrating the woven fabric with the film material. At 130, the method includes laminating the woven fabric with the film material. During this step, the woven fabric is placed between two sheets of the film material and the resulting stack is heat pressed in a laminator to form a laminated sheet.

Returning to FIG. 1, at 132, the method 100 includes digital printing on the film material. Images, logos, text, designs, etc. may be printed on the film material. Preferably, the printing is performed with solvent-based or latex-based inks, although any suitable ink, dye, paint, and/or pigment may be used. At 134, the method 100 includes trimming excess film material, for example, by laser cutting. Because the woven fabric can be configured in a variety of complex shapes while the film material is generally formed in rectangular sheets, trimming excess film material provides the woven inflatable device with a predetermined shape. The predetermined shape may closely follow an outline of the woven fabric in which case the predetermined shape is similar to a shape of the woven fabric. Alternatively, the predetermined shape may differ from the outline of the woven fabric, leaving portions of the resulting structure not having the woven fabric. These portions not having the woven fabric possess different properties (e.g. elasticity) from portions having the woven fabric.

At 136, the method 100 includes finishing steps to form the woven inflatable device. Finishing steps include installing fasteners, straps, valves, inflators, or any other parts providing additional functionality to the woven inflatable device.

An advantage of the method 100 is that a variety of environmentally friendly materials can be used in constructing the woven inflatable device. The yarns may comprise recycled polyethylene terephthalate (PET), recycled polyamide (PA), recycled polyester, and/or cotton. The film material may comprise recycled PET, recycled PA, recycled polyester, bio-based polyesters, bio-based polyester polyols, and bio-based polyurethanes. In the context of the present disclosure, the term bio-based refers to materials ultimately derived from living or once-living organisms. Preferably, the living organisms are a renewable crop that for which agricultural infrastructure is well established, as is the case, for example, for corn. It will be appreciated that the above-mentioned materials are exemplary, and that other materials may be used to form the yarns and film material. The yarns and film material are recyclable, and therefore a minimal amount of waste is produced at an end of the woven inflatable device's use. Additionally, the above-mentioned materials are less toxic than alternative materials such as polyvinyl chloride (PVC), for example.

Inflatable devices manufactured according to the methods described herein provide the potential of being light weight and compact in the deflated state, yet functional and rigid in the inflated state. Inflatable devices such as the cooler, chair, containers, and kiteboard harnesses described herein provide their users with new functionalities in new form factors, all while helping to minimize the ecological impact of these types of products.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An inflatable kiteboard harness, comprising:

a laminated sheet formed in a planar shape and configured to be inflated and folded to transform to a three-dimensional kiteboard harness shape, wherein the laminated sheet includes:

multiple inflatable regions including an inflatable central lumbar region, an inflatable right lumbar region, and an inflatable left lumbar region, a pair of flaps being attached to lateral outside edges of at least the inflatable right lumbar region and inflatable left lumbar region, respectively;

a first folding seam between the inflatable left lumbar region and the inflatable central lumbar region, and a second folding seam between the inflatable right lumbar region and the inflatable central lumbar region, each of the first and second folding seams having a seam-crossing passage positioned across the corresponding first or second folding seam that enables fluidic communication across the respective seam; and an air inlet positioned in the inflatable regions, wherein the air inlet is configured to receive air from an inflator to raise the air pressure inside the multiple inflatable regions, to transform the laminated sheet from the planar shape to the three-dimensional kiteboard harness shape in an inflated state, and wherein each of the multiple inflatable regions includes interior yarn stretching from interior front side to an interior back side of the laminated sheet, the yarn being configured, when the inflatable regions are inflated, to be stretched taut and define the three-dimensional kiteboard harness shape for each of the multiple inflatable regions in the inflated state shape.

2. The inflatable kiteboard harness of claim 1, wherein the inflator is selectively coupled to the air inlet.

3. The inflatable kiteboard harness of claim 1, wherein each of the multiple inflatable regions includes an interior pattern of welded connections connecting a front and a back of the laminated sheet, the pattern being selected from the group comprising a vertical linear and a symmetric dot pattern.

4. The inflatable kiteboard harness of claim 1, further comprising:

an anterior belt member coupled to each of the flaps, wherein the anterior belt member includes:

an adjustable strap configured to vary the length of the belt member;

a hook configured to engage with a chicken loop of a kiteboard tether; and/or a leash coupled by a leash release mechanism.

* * * * *